US007735252B1

(12) United States Patent
Laney et al.

(10) Patent No.: US 7,735,252 B1
(45) Date of Patent: Jun. 15, 2010

(54) FIREARM MAGAZINE AND ADAPTER THEREFOR

(75) Inventors: Mark C. Laney, Lee, NH (US); Brian D. Richard, Springvale, ME (US)

(73) Assignee: Thompson Center Arms Co., Inc., Rochester, NH (US)

( * ) Notice: Subject to any disclaimer, the term of this patent is extended or adjusted under 35 U.S.C. 154(b) by 0 days.

(21) Appl. No.: 12/345,999

(22) Filed: Dec. 30, 2008

(51) Int. Cl.
*F41A 9/61* (2006.01)

(52) U.S. Cl. ..... 42/49.02

(58) Field of Classification Search ..... 42/49.01–50, 42/106

See application file for complete search history.

(56) References Cited

U.S. PATENT DOCUMENTS 5,438,783 A * 8/1995 Sniezak et al. ..... 42/7
5,664,355 A * 9/1997 Ronkainen ..... 42/18
6,367,188 B1 * 4/2002 Vargas ..... 42/106
7,069,683 B1 * 7/2006 Kapusta ..... 42/70.02
7,140,138 B1 11/2006 Laney et al.
7,257,917 B1 8/2007 Garland
2005/0115128 A1 * 6/2005 Hahin ..... 42/50
2007/0137084 A1 6/2007 Laney et al.
2007/0163162 A1 7/2007 Laney et al.
2007/0175077 A1 8/2007 Laney et al.
2009/0223103 A1 * 9/2009 Young ..... 42/50

* cited by examiner

*Primary Examiner*—Bret Hayes
*Assistant Examiner*—Reginald Tillman, Jr.
(74) *Attorney, Agent, or Firm*—McCormick, Paulding & Huber LLP

(57) ABSTRACT

A firearm magazine includes a housing defining a cavity. A resilient member is disposed in the cavity. A cartridge support member is movably supported on the resilient member and configured for moving downwardly into the cavity against increasing tension of the resilient member when the magazine is being loaded. The resilient member when under tension urges the cartridge support member and cartridges thereon to move upwardly during a feeding operation. An adapter converts a firearm magazine from multiple cartridge capacity to single cartridge capacity, and is configured to be removably coupled to the upper housing to cover the cartridge support member of the housing. The adapter includes an additional cartridge support member. The housing and the adapter cooperate to prevent the additional cartridge support member of the adapter from being moved downwardly into the cavity.

9 Claims, 4 Drawing Sheets

FIREARM MAGAZINE AND ADAPTER THEREFOR

FIELD OF THE INVENTION

The present invention is directed generally to a firearm magazine, and more particularly to an adapter for converting a firearm magazine to single shot operation.

BACKGROUND OF THE INVENTION

Firearm magazines typically are configured for holding several cartridges. However, there are situations where the user of a firearm might prefer to limit the capacity of a magazine to a single cartridge. For example, in situations such as target shooting or loading a rifle on a bench rest, the user may wish to open the bolt, simply and accurately load a single cartridge into the breech through the opened window defined on the upper side of the receiver, and close the bolt such that the cartridge stands chambered and ready to be fired.

In view of the foregoing, there is a need to easily and quickly convert a magazine with multiple cartridge capacity into a magazine with single cartridge capacity.

SUMMARY OF THE INVENTION

In a first aspect of the present invention, a firearm magazine includes a housing defining a cavity for accommodating a plurality of cartridges. A resilient member is disposed in the cavity. A cartridge support member is movably supported on the resilient member and configured for being moved downwardly into the cavity against increasing tension of the resilient member when the magazine is being loaded with cartridges. The resilient member is configured when under tension for urging the cartridge support member and cartridges when disposed thereon to move upwardly toward an upper portion of the housing when feeding a firearm with a cartridge. An adapter is provided for converting a firearm magazine from multiple cartridge capacity to single cartridge capacity. The adapter is configured to be removably coupled to the upper portion of the housing so as to cover the cartridge support member of the housing. The adapter includes an additional cartridge support member. The housing and the adapter cooperate to prevent the additional cartridge support member of the adapter from being moved downwardly into the cavity.

In a second aspect of the present invention, an adapter for converting a multiple cartridge capacity firearm magazine to a single cartridge capacity magazine includes sidewalls each having a downwardly depending portion at a lower portion. The sidewalls each define a chamfered surface at an upper portion. The chamfered surfaces of the adapter each are configured to progressively narrow the width between the sidewalls of the adapter from a lower end of the chamfered surface to an upper end of the chamfered surface so as to engage opposing chamfered surfaces of a magazine housing. A cartridge support member is immovably disposed between the sidewalls at an upper portion thereof for supporting a single cartridge thereon.

DETAILED DESCRIPTION OF THE PREFERRED EMBODIMENT

With reference to FIGS. 1-7, a firearm magazine embodying the present invention is generally indicated by the reference number 10. The magazine 10 includes a housing 12 defining a cavity 14 (see FIG. 2) for accommodating a plurality of cartridges. The magazine 10 is a three round, single stack magazine by way of example, but can be a dual stack magazine and can have a different cartridge capacity without departing from the scope of the present invention.

Figure 1:
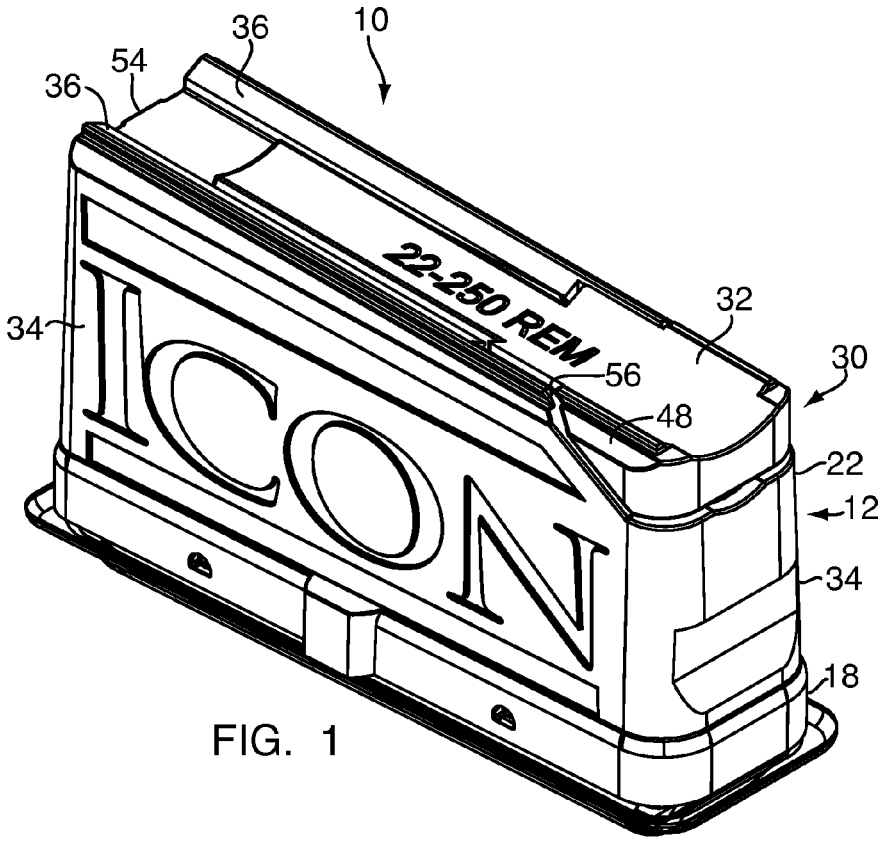
FIG. 1 is a perspective view of a firearm magazine including adapter embodying the present invention.
Figure 2:
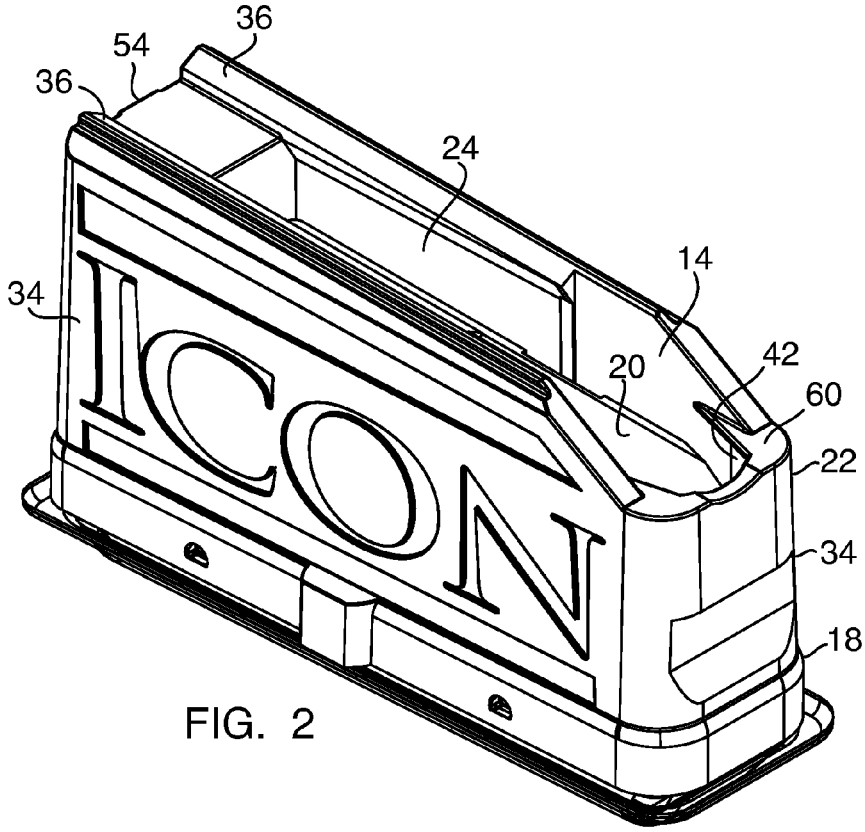
FIG. 2 is a perspective view of the firearm magazine without the adapter.
Figure 3:
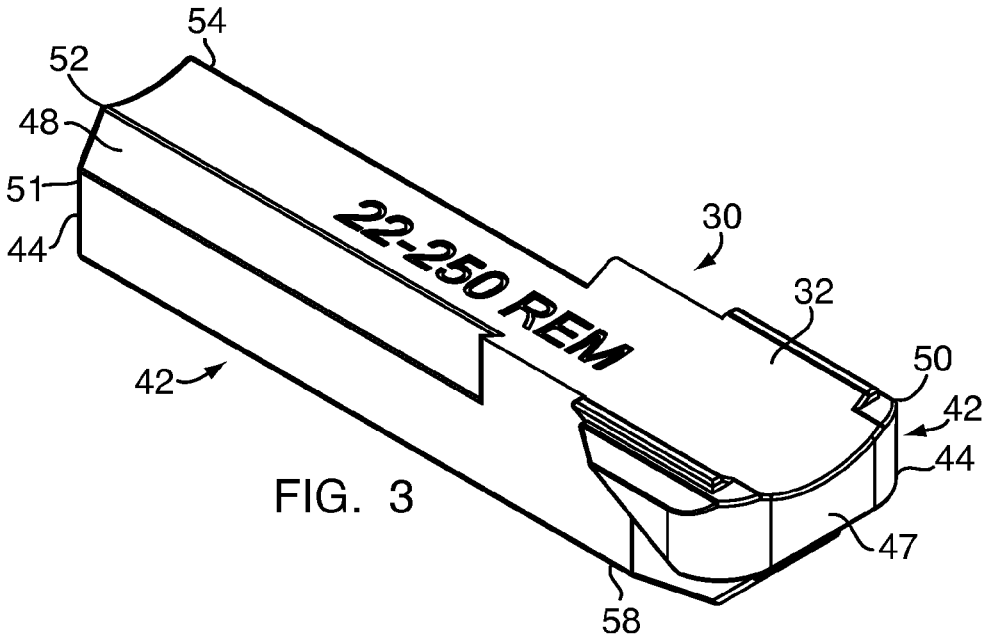
FIG. 3 is an upper perspective view of an adapter embodying the present invention.
Figure 4:
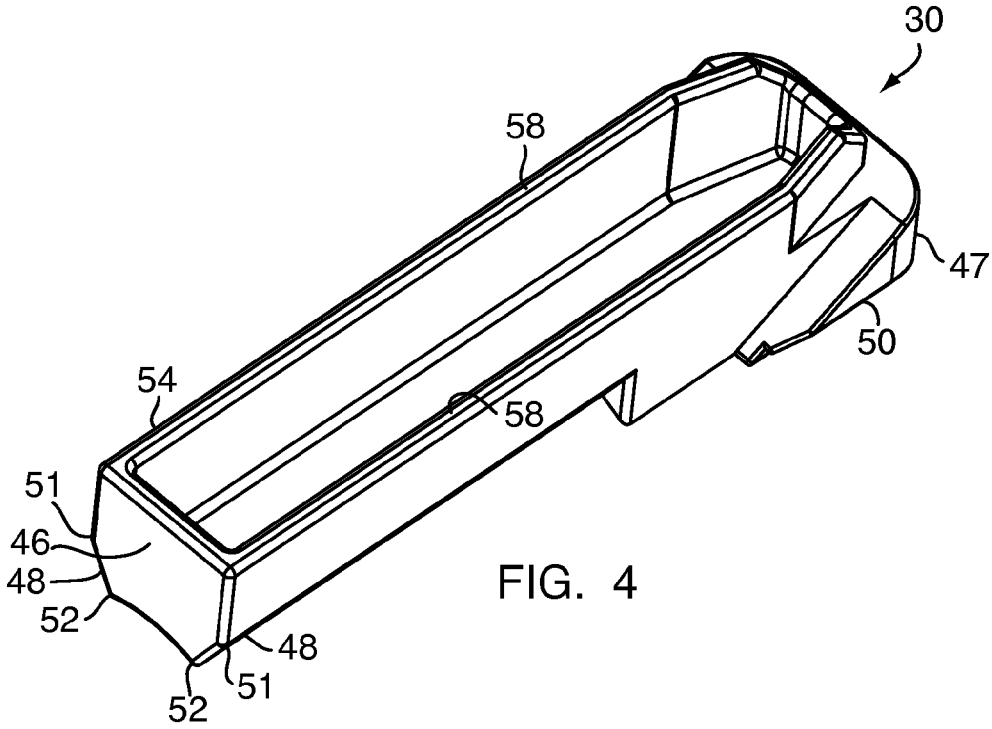
FIG. 4 is a lower perspective view of the adapter.
Figure 5:
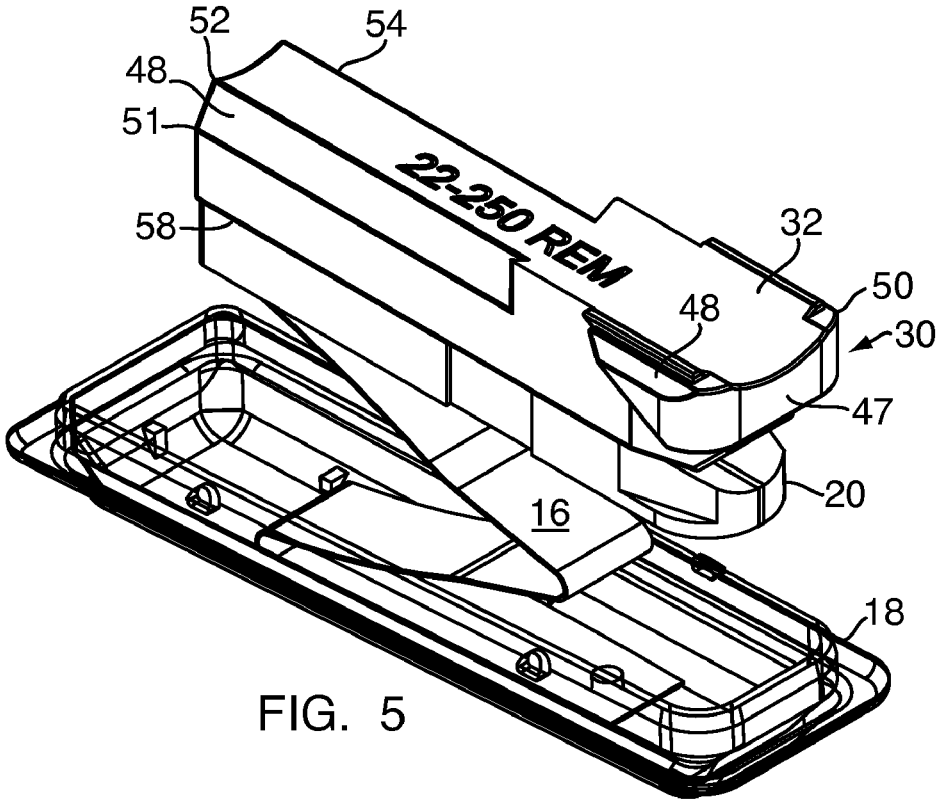
FIG. 5 is a perspective view of the firearm magazine with the housing removed for clarity.
Figure 6:
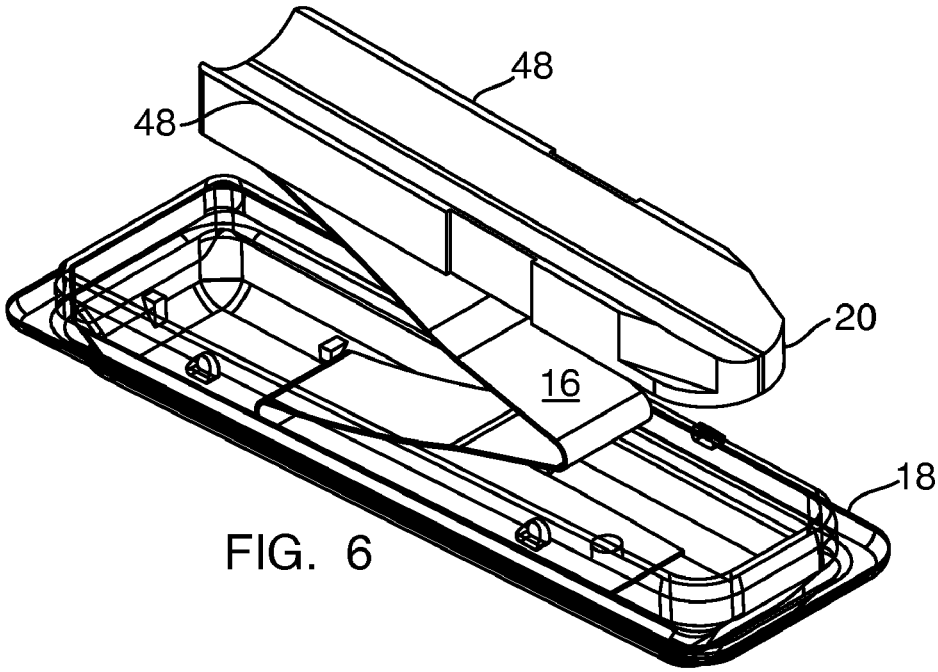
FIG. 6 is a perspective view of the firearm magazine with the housing and adapter removed for clarity.
Figure 7:
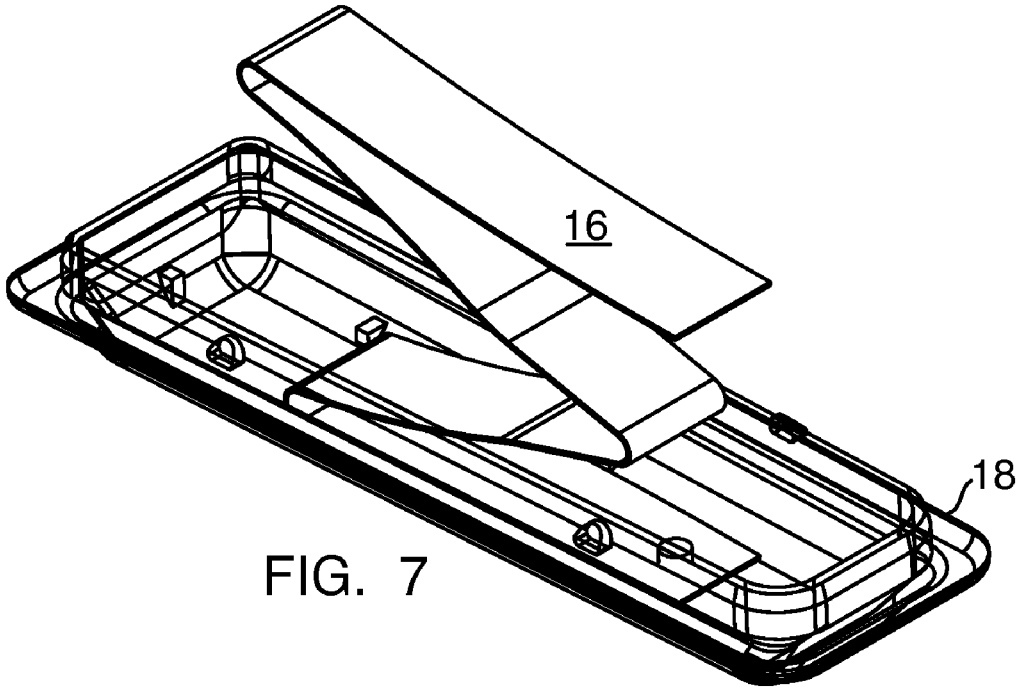
FIG. 7 is a perspective view of the firearm magazine with the housing, adapter and cartridge support member removed for clarity.

As shown in FIGS. 5-7, a resilient member such as, for example, a spring element 16 is disposed in the cavity 14 adjacent to a bottom portion 18 of the housing 12. A cartridge support member 20 is movably supported on the spring element 16 for being moved downwardly into the cavity 14 against increasing tension of the spring element 10 when the magazine is being loaded with cartridges prior to insertion of the magazine into a firearm. The cartridge support member 20 is also movably supported on the spring element 16 such that the spring element when under tension urges the cartridge support member 20 and cartridges when disposed thereon to move upwardly toward an upper portion 22 of the housing 12 when the magazine 10 is feeding a firearm with a cartridge.

As best shown in FIG. 6, the cartridge support member 20 defines a surface having a generally elongated concave shape for accommodating a complementary shape of a generally cylindrical cartridge to be supported thereon. The upper portion 22 of the housing 12 defines an opening 24 for exposing the cartridge support member 20 so as to enable cartridges to be loaded thereon and to enable cartridges to be fed from the magazine 10 into a firearm chamber.

As shown in FIGS. 1 and 3-5, the firearm magazine 10 further includes an adapter 30 for easily and quickly converting the magazine from multiple cartridge capacity to single cartridge capacity. The adapter 30 has an additional cartridge support member 32 defining a surface having a generally elongated concave shape for accommodating the complementary shape of a generally cylindrical cartridge to be supported thereon.

The adapter 30 is configured to be removably coupled to the upper portion 22 of the housing 12 in order to selectively change the magazine 10 from multiple cartridge capacity to single cartridge capacity. Moreover, the adapter 30 is configured to engage the upper portion 22 of the housing 12 so as to cover the cartridge support member 20 of the housing. The housing 12 and the adapter 30 cooperate to prevent the additional cartridge support member 32 of the adapter from being moved downwardly into the cavity 14 so as to prevent the housing from feeding more than one cartridge into a firearm.

The housing 12 has sidewalls 34 each defining a chamfered surface 36 projecting inwardly into the cavity 14 at the upper portion 22 of the housing. The chamfered surfaces 36 each extend along at least a portion of a length L of the associated sidewall 34. The chamfered surfaces 36 each are configured to progressively narrow the width of the cavity 14 from a lower end 38 of the chamfered surface to an upper end 40 thereof so as to form an upwardly sloped overhang for the reason to be explained more fully below.

The adapter 30 has sidewalls 42 each having a downwardly depending portion 44 at a lower portion thereof, and each defining a chamfered surface 48 at an upper portion 50 thereof having a complementary shape to that of one of the chamfered surfaces 36 of the housing 12. The adapter 30 further includes a rearward end wall 46 and a forward end wall 47 each disposed between the sidewalls 42. The additional cartridge support member 32 is immovably disposed between the sidewalls 42. The chamfered surfaces 48 of the adapter 30 each are configured to securely abut against an opposing chamfered surface 36 of the housing 12. Moreover, the chamfered surfaces 48 of the adapter 30 each are configured to progressively narrow the width between the sidewalls 42 of the adapter from a lower end 50 of the chamfered surface 48 to an upper end 51 thereof.

The adapter 30 is configured to be removably coupled to the housing 12 of the magazine 10 by slidably engaging the chamfered surfaces 48 of the adapter against the chamfered surfaces 36 of the housing 12. More specifically, the adapter 30 is coupled to the housing 12 by tilting a rearward end 54 of the adapter downwardly against the cartridge support member 20 of the housing to move the cartridge support member of the housing downwardly into the cavity 14 and thereby to allow the chamfered surfaces 48 of the adapter to slide below and into abutting engagement with the opposing chamfered surfaces 36 of the housing. The adapter 30 then tilts back such that the additional cartridge support member 32 has a support surface generally flush with an upper end 56 of the housing 12 when in a fully engaged position. The flush position ensures that the support surface of the additional cartridge support member 32 is disposed adjacent to a breech of a firearm when the magazine 10 is inserted in the firearm. With this positioning, a cartridge can be accurately inserted into the breech when the bolt is opened by simply resting the cartridge on the additional cartridge support member 32.

With respect to the adapter 30, the lower portion of the sidewalls 42 define a downwardly facing surface 58. The housing 12 defines an upwardly facing surface 60 at the upper portion 50. When the adapter 30 is coupled to the housing 12, the downwardly facing surface 58 of the adapter abuts against the upwardly facing surface 60 of the housing creating an obstacle so as to prevent the adapter from being moved downwardly into the cavity 14, thereby limiting the magazine 10 to single cartridge capacity. Moreover, the chamfered surfaces 36 of the housing 12 each form an upwardly sloped overhang which when abutting against the opposing chamfered surfaces 48 of the adapter 30 prevents the adapter from accidentally moving upwardly out of engagement with the housing. Moreover, when the adapter 30 is coupled to the housing 12, the forward end wall 47 of the adapter is disposed in the cavity 14 and securely abuts against an inner wall 62 of the housing. Thus, the abutting surfaces of the adapter 30 and the housing 12 create an obstacle to prevent the adapter from accidentally sliding forwardly out of engagement with the housing.

The adapter 30 is useful for situations where a firearm user prefers to limit the firearm to single shot operation. For example, in situations such as target shooting or loading a rifle on a bench rest, the user may wish to open the bolt, simply and accurately load a single cartridge into the breech through the opened window defined in the upper side of the receiver, and close the bolt such that the cartridge stands chambered and ready to be fired. Therefore, the adapter 30 is ideal for quickly and easily converting an otherwise multiple cartridge capacity magazine to single cartridge capacity for the above-mentioned situations.

To summarize the operation of loading, when the magazine 10 with the adapter 30 coupled to the housing 12 is engaged in, for example, a bolt action firearm, the bolt is rotated and pulled back to clear, the breech is then opened and a single cartridge is inserted and will simply stand ready to be chambered when the bolt is rotated back and urged forward before locking in place.

When the firearm user wishes to convert a firearm back to multiple shot operation, the firearm user can quickly and easily remove the adapter 30 from the housing 12 of the magazine 10 by tilting the rearward end 54 of the adapter 30 downwardly against the cartridge support member 20 of the housing 12 which moves the cartridge support member of the housing downwardly into the cavity 14. The tilting action allows the forward end wall 47 of the adapter to move upwardly away from and out of abutting engagement against the inner wall 62 of the housing 12, thereby allowing the chamfered surfaces 48 of the adapter 30 to slide forwardly relative to and out of abutting engagement with the opposing chamfered surfaces 36 of the housing 12.

Although the invention has been described and illustrated with respect to an exemplary embodiment thereof, the foregoing and various other additions and omissions may be made therein and thereto without departing from the spirit and scope of the present invention.

What is claimed is:

1. A firearm magazine comprising:

a housing having longitudinal sidewalls and transverse sidewalls defining a cavity for accommodating a plurality of cartridges, each longitudinal sidewall including a first portion having downward-facing chamfered surfaces projecting inwardly into the cavity at the upper portion of the housing, and including a second portion defining a chamfered surface angled downwardly from said first portion to one of the transverse sidewalls;

a resilient member disposed in the cavity;

a cartridge support member movably supported on the resilient member and configured for being moved downwardly into the cavity against increasing tension of the resilient member when the magazine is being loaded with cartridges, and configured such that the resilient member when under tension urges the cartridge support member and cartridges when disposed thereon to move upwardly toward an upper portion of the housing when feeding a firearm with a cartridge; and an adapter for converting a firearm magazine from multiple cartridge capacity to single cartridge capacity, the adapter being configured to be removably coupled to the upper portion of the housing so as to cover the cartridge support member of the housing, and the adapter including an additional cartridge support member, the adapter including sidewalls each having an upward-facing chamfered surface at an upper portion complementary to the downward-facing chamfered surfaces of the longitudinal sidewalls of said housing and having a downwardly depending portion at a lower portion, and the adapter also including a transverse end wall having chamfered surfaces angled upwardly from said end wall outside said sidewalls and complementary to the downwardly-angled chamfered surfaces of the second portions of the longitudinal sidewalls of said housing, the complementary chamfered surfaces of the housing and the adapter cooperating to positively engage the adapter with the housing and prevent the adapter from being moved downwardly into the housing.

2. A firearm magazine as defined in claim 1, wherein the chamfered surfaces of the housing each extend along a portion of a length of the associated sidewall of the housing.

3. A firearm magazine as defined in claim 1, wherein the chamfered surfaces of the housing each are configured to progressively narrow the width of the cavity from a lower end of the chamfered surface to an upper end of the chamfered surface so as to form an upwardly sloped overhang.

4. A firearm magazine as defined in claim 1, wherein the chamfered surfaces of the adapter each are configured to progressively narrow the width between the sidewalls of the adapter from a lower end of the chamfered surface to an upper end of the chamfered surface.

5. A firearm magazine as defined in claim 1, wherein the resilient member includes a spring element.

6. A firearm magazine as defined in claim 1, wherein the cartridge support member of the housing defines a surface having a generally elongated concave shape for accommodating a complementary shape of a generally cylindrical cartridge to be supported thereon.

7. A firearm magazine as defined in claim 1, wherein the additional cartridge support member of the adapter defines a surface having generally elongated concave shape for accommodating a complementary shape of a generally cylindrical cartridge to be supported thereon.

8. An adapter for converting a multiple cartridge capacity firearm magazine to a single cartridge capacity magazine, the adapter comprising:

sidewalls each having a downwardly depending portion at a lower portion, the sidewalls each defining a chamfered surface at an upper portion, the chamfered surfaces of the adapter each being configured to progressively narrow the width between the sidewalls of the adapter from a lower end of the chamfered surface to an upper end of the chamfered surface;

an end wall having chamfered surfaces angled upwardly from a lower surface of said end wall outside the downwardly depending portions of said sidewalls; and a cartridge support member immovably disposed between the sidewalls at an upper portion thereof for supporting a single cartridge thereon.

9. An adapter as defined in claim 8, wherein the cartridge support member defines a surface having generally elongated concave shape for accommodating a complementary shape of a generally cylindrical cartridge to be supported thereon.

* * * * *